United States Patent [19]

Smit

[11] Patent Number: 4,735,306

[45] Date of Patent: Apr. 5, 1988

[54] PALLET WITH PAINT RECEPTACLES

[76] Inventor: Adrianus J. Smit, Oelegemsteenweg 69, 2230 Shilde, Belgium

[21] Appl. No.: 13,582

[22] Filed: Feb. 11, 1987

[30] Foreign Application Priority Data

Feb. 11, 1986 [BE] Belgium ..... 904215

[51] Int. Cl.[4] ..... B65D 83/00

[52] U.S. Cl. ..... 206/1.8; 434/103; D19/35

[58] Field of Search ..... 206/1.7, 1.8; 434/103; D19/35

[56] References Cited

U.S. PATENT DOCUMENTS 1,391,028 9/1921 Werntz ..... 206/1.8

4,027,404 6/1977 Brant ..... 206/1.8

*Primary Examiner*—William Price

*Attorney, Agent, or Firm*—Cushman, Darby & Cushman

[57] ABSTRACT

There is described a painter implement, more particularly a pallet with a base, such as a plate, whereon a plurality of locations for ready-to-use paint are provided, in which at least one receptacle wherein a liquid and/or paste supply can be stored, is mounted on said base, whereby means are provided to connect said receptacle with at least one said locations.

16 Claims, 2 Drawing Sheets

PALLET WITH PAINT RECEPTACLES

This invention relates to a painter implement, more particularly a pallet, with a base such as a plate, whereon a number locations are provided for ready-to-use paint.

One of the most peculiar drawbacks of a conventional painter pallet lies in the amount ready-to-use paint which may be provided thereon, without the various colour kinds contacting one another, being relatively limited. This results, at least when the running together of the various colour kinds is to be avoided, in the paint amount on the pallet having to be frequently filled up. This is thus very time-consuming and moreover comprises a rather unpleasant chore which has to be performed very carefully. such drawbacks are particularly severe when use is made of relatively liquid water colour.

The object of the present invention is to obviate said drawbacks in a very simple and handy way.

For this purpose, at least one receptacle wherein a liquid and/or paste supply may be stored, is mounted on the above-mentioned base, whereby means are provided to connect said receptacle with at least one of said locations for ready-to-use paint.

A discrete receptacle is provided for each of said locations.

In a particular embodiment of the invention, the receptacle has a substantially tight sealable filling opening and a metering opening, whereby at least one portion of the receptacle wall is resiliently distortable, in such a way that when the filling opening is closed and the metering opening is open, by pressing on said resiliently-distortable receptacle portion, an adjustable amount of that liquid or paste enclosed therein can be forced out of the receptacle to said location for ready-to-use paint.

In a more particular embodiment of the invention, said receptacle comprises a substantially dome-shaped housing made of resiliently-distortable material which is provided at the top with said closable filling opening and which is open at the bottom, whereby the edge of the housing open end removably and resiliently connects to a projecting foot. This projecting foot lies substantially next to said location for ready-to-use paint. Said metering opening is provided approximately level with said foot, on the side of said location, in such a way that by resiliently pressing the housing, the liquid or paste lying therein can be forced through the metering opening, towards said location.

The invention further pertains to a pigment tablet which can be used advantageously with the above-defined painter implement.

Said pigment tablet contains between 15 and 25% physiologically-harmless pigment, between 65 and 75% inert filler, such as ground clay or lime, and between 5 and 15% gum Arabic.

Other details and advantages of the invention will stand out from the following description, given by way of non limitative example and with reference to the accompanying drawings, in which.

In the various figures, the same reference numerals pertain to the same elements.

Figure 1:
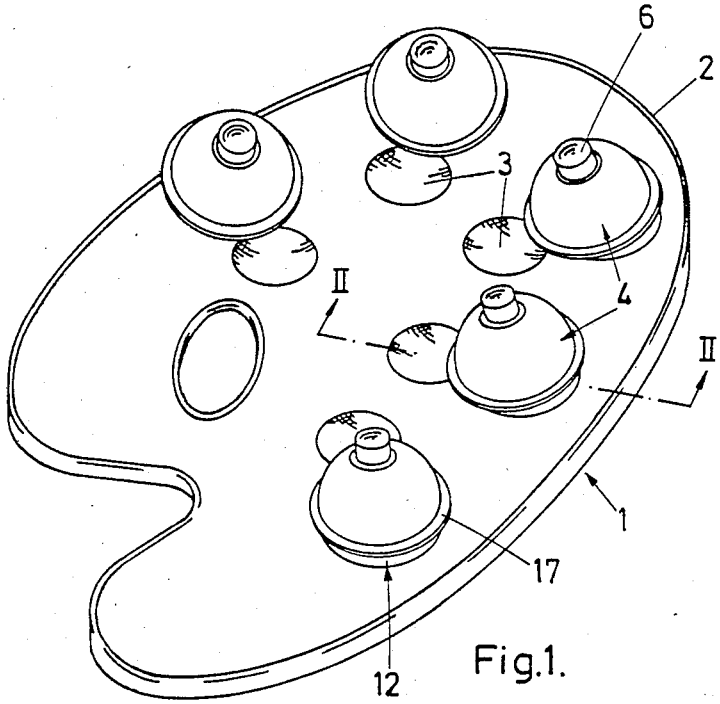
FIG. 1 is a perspective view of a painter pallet in a particular embodiment according to the invention.

The invention generally relates to a painter implement with a base whereon a number of locations for ready-to-use paint are provided, and whereon at least one receptacle wherein a liquid and/or paste supply can be stored, is further mounted. This receptacle may be connected to one of said locations.

The painter implement which is contemplated according to the invention, is formed by a painter pallet.

This is also the reason why such a pallet will be described hereinafter to illustrate the invention, with reference to the accompanying figures.

The pallet as shown in the figures, is generally of oval shape, but it is clear that it may have any shape whatsoever, for example a rectangular shape.

Said pallet is comprised of a plate 1 which is bounded along the whole circumference thereof by an upstanding rim 2. The locations for ready-to-use paint are formed by a number of containers which are formed by relatively shallow cavities 3 provided in said plate 1.

In the embodiment as shown, here are five containers.

A discrete receptacle 4 is provided for each cavity, wherein a liquid supply can be stored.

Said receptacles 4 and the cavities 3, are identical in shape and size to one another.

Each receptacle 4 has a filling opening 5 which is tightly closed by means of a cone-shaped stopper 6, and a metering opening 7 wherethrough each receptacle can communicate with a cavity 3.

Figure 2:
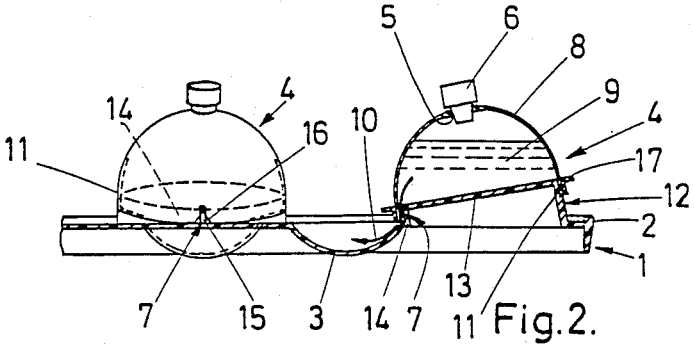
FIG. 2 is on a somewhat larger scale, a cross-section along line II—II in FIG. 1.
Figure 3:
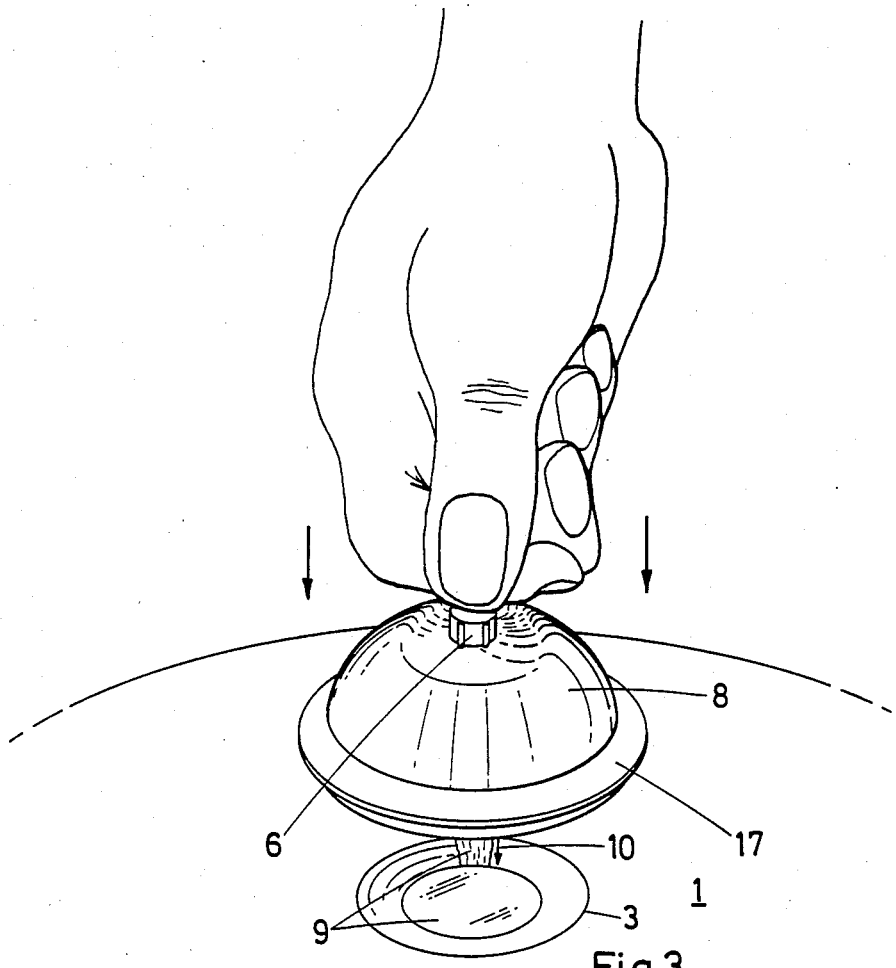
FIG. 3 shows on a still larger scale, a perspective view of a portion from said painter pallet, showing the working thereof.

At least one portion from the wall 8 of receptacle 4 is so resiliently distortable that when the filling opening 5 is closed and the metering opening 7 is open, by pressing on said resiliently-distortable receptacle portion, an adjustable amount of that liquid 9 enclosed therein can be forced through said metering opening 7 out of receptacle 4 into the adjacent cavity 3, as shown by arrow 10 in FIGS. 2 and 3.

In the particular embodiment which is shown in the figures, the resiliently-distortable wall 8 is comprised of a dome-shaped housing from resiliently-distortable material, which has the filling opening 5 at the top and which is open at the bottom.

The open end edge 11 from housing 8 connects removably, resiliently and tightly to a projecting foot 12 which lies next to each cavity 3 for ready-to-use paint.

The metering opening 7 is provided level with said foot 12, on the side of said adjacent cavity 3, in such a way that due to resiliently pressing said housing 8, as clearly shown in FIG. 3, that liquid 9 lying inside said housing, is forced through the metering opening 7 into said cavity 3.

Each receptacle 4 is thus formed by a dome-shaped housing 8 and a foot 12, which forms the receptacle bottom.

Each receptacle further communicates by a narrow-enough passageway, through said metering opening 7, with an adjacent cavity 3, and in such a way no liquid can escape from the receptacle along said passageway when the receptacle filling opening 5 is closed and the pressure prevailing on the liquid inside the receptacle, does not exceed the atmospheric pressure. This refers then also preferably to a substantially capillary passageway.

In the particular embodiment as shown in the figures, the metering opening 7 is defined by one upstanding groove 15 provided in the rim 14 and one recess 16 provided in the open end edge 11 from housing 8, which recess 16 lies partly facing said groove 15. Said recess 16 is formed more particularly by a triangle-shaped notch in edge 11.

The edge 11 of housing 8 is secured, preferably by means of a somewhat-resilient locking ring 17, on the edge 14 of foot 12, to insure the tightness of receptacle 4 in this location.

The surface 13 from foot 12 which thus defines the bottom of receptacle 4, is further designed as to slant downward in the direction of the adjacent cavity 3, so that thus all that liquid 9 lying inside receptacle 4 may in a simple way easily be discharged into said cavity.

In the embodiment as shown, the metering opening 7 opens out level with the edge of said cavity 3, in such a way that when an excess liquid 9 is forced out of the receptacle, by distorting the dome-shaped housing 8, such excess is automatically sucked back when the pressure being exerted from the outside on housing 8 is discontinued and said housing thus returns to the original shape thereof.

As clearly shown in FIG. 3, the stopper 6 may serve as a push-button for compressing the housing, that is to convey liquid 9 to cavity 3, as shown with arrow 10.

To let the liquid content of the receptacle be continuously monitored, it may be useful tomanufacture same from a transparent material.

The pallet as shown in the figures, according to the invention, may advantageously be manufactured from a synthetic material plate, which thus forms the plate 1 wherein the cavities 3 are formed by concave distortions provided in the plate top side, while the foot 12 is comprised of a projecting distortion provided in the top side of said same plate.

When use is made of a thermoplastic material, very conventional techniques may be used, such as deep-drawing, pneumatic heat-forming in a male or female die.

The paint being used with the painter pallet according to the invention, may be prepared by means of a solvent for pigment tablets which may be arranged in the receptacle. More particularly when use is made of water colour, the solvent can be water which is poured into the receptacle through the filling opening 5 and wherein one or a plurality of tablets with the required colour can be dissolved depending on the required concentration.

According to the invention, said pigment or paint tablets can be comprised of 15 to 25% physiologically-harmless dye or pigment, 65 to 75% inert filler such as ground pure clay or lime, and 5 to 15% gum Arabica.

The pigment tablet is preferably comprised of about 20% physiologically-harmless dye, approximately 70% inert filler and approximately 10% gum Arabica.

When using the above-described painter pallet as shown in the figures, one preferably operates as follows. A fast water-soluble pigment tablet is arranged through filling opening 5 in the dome-shaped housing 8. Said housing is filled thereafter with water and sealed tight with the stopper 6.

After about 3 minutes, the tablet is completely dissolved. The dissolving may possibly be accelerated by shaking the pallet somewhat. One push thereafter on the stopper 6, as shown in FIG. 3, which causes a volume reduction inside housing 8. This generates an overpressure therein, in such a way that the dissolved pigment flows through the metering opening 7 in the adjacent cavity 3. As soon as the required amount of paint lies in said cavity 3, the stopper 6 is released and due to the resilient properties of that material the housing 8 is made of, said housing returns to the original shape thereof, and simultaneously air is thus sucked through metering opening 7. As the cross-section of said metering opening 7 is relatively small, possibly +0.005 mm, no pigment flows any more from receptacle 4 to cavity 3, even when the metering opening 7 is not closed off.

Furthermore, when an excess paint is fed to cavity 3 during pressing of housing 8, the excess paint is sucked back through the metering opening as soon as the housing returns to the original shape thereof.

In this way, it is thus always possible to provide the required amount of ready-to-use paint in the cavities 3, without having to resort to special precautions. There is thus no danger that due to an excess supply in a particular cavity, paint will reach another cavity; the locations for ready-to-use paint on the pallet thus always remain clearly separated from one another.

By making use of pigment tablets, the conveying and packaging may be strongly simplified as the required solvent only has to be added when the pallet is being used.

The invention is naturally in no way limited to the above embodiments and many changes may be made thereto without departing from the scope of the invention as defined in the appended claims.

Even if the painter pallet is to be considered as the most important application of the invention, various other applications are not excluded, such as a paint box with one or a plurality of receptacles for solvent.

Instead of liquid paint, use might possibly be made of paint paste which is arranged in a receptacle which is mounted, removably or not, on a base, whereby said receptacles communicate with locations provided on said same base, for ready-to-use paint.

I claim:

1. A painter implement comprising:

a base having at least one location for ready-to-use paint, at least one receptacle, wherein a supply of liquid and/or paste material can be stored, having a substantially tightly sealable filling opening and a metering opening, and means for connecting said receptacle adjacent said location, at least one portion of the receptacle wall being resiliently distortable in such a way that, when the filling opening is closed, by pressing said resiliently distortable wall portion, an adjustable amount of said material in said receptacle is forced through the metering opening out of the receptacle into said location for ready-to-use paint.

2. Painter implement as defined in claim 1, in which a discrete receptacle is provided for said location.

3. Painer implement as defined in claim 1, in which said location is a container.

4. Painer implement as defined in claim 3, in which said container is formed by relatively shallow cavities provided in a plate.

5. Painter implement as defined in claim 1, in which the receptacle comprises a substantially dome-shaped housing from resiliently-distortable material, which has at the top said closable filling opening and is open at the bottom, whereby the edge of the housing open end connects removably, resiliently and substantially tightly with a projecting foot, which lies substantially next to said location for ready-to-use paint, and whereby said metering opening is provided substantially level with said foot, on the side of said location, in such a way that due to resiliently pressing the housing, the liquid or paste lying therein, is forced through the metering opening to said location.

6. Painter implement as defined in claim 5, in which the metering opening is defined by an upstanding groove provided in the foot rim, and by a recess provided in the edge of the housing open end which fits around said foot, which recess lies facing partly at least said groove.

7. Painter implement as defined in claim 1, in which the receptacle communicates by a narrow-enough passageway, through a metering opening, with at least one said locations for ready-to-use paint, and this in such a way that no liquid escapes from the receptacle through said passageway when the receptacle filling opening is closed and the pressure prevailing on the paint therein does not exceed the atmospheric pressure.

8. Painter implement as defined in claim 1, in which the receptacle communicates by a capillary-enough passageway, with at least one said locations for ready-to-use paint.

9. Painter implement as defined in claim 5, in which the edge of the housing open end is removably secured by means of a locking ring, on the foot rim.

10. Painter implement as defined in claim 5, in which said foot is so designed as to slant downwards in the direction of the location for ready-to-use paint.

11. Painter implement as defined in claim 3, in which the metering opening opens out level with the maximum allowable filling level of the containers which form the location for ready-to-use paint.

12. Painter implement as defined in claim 1, in which the filling opening lies in the distortable receptacle portion and is closed by means of a stopper, which serves as push-button for pressing the receptacle.

13. Painter implement as defined in claim 1, in which the receptacle is at least partly transparent.

14. Painter implement as defined in claim 1, which is formed by a pallet which is comprised of a synthetic material plate wherein the locations for ready-to-use paint are formed by concave distortions provided in the top side of said plate.

15. Painter implement as defined in claim 5, in which the foot for said dome-shaped housing is formed by a projecting distortion in the plate top side.

16. Painter implement as defined in claim 14, wherein the receptacle comprises a substantially domed shaped housing whereby the edge of the housing open end connects removably, resiliently and substantially tightly with a projecting foot which lies substantially next to said location for ready-to-use paint and said foot is formed by a projecting distortion in the plate top side.

* * * * *